US007387823B2

(12) United States Patent
Waterford

(10) Patent No.: US 7,387,823 B2
(45) Date of Patent: Jun. 17, 2008

(54) SYNTHETIC SPORTS SURFACE

(76) Inventor: Gary Wayne Waterford, 44 Balfour Road, Rose Bay, NSW 2029 (AU)

( * ) Notice: Subject to any disclaimer, the term of this patent is extended or adjusted under 35 U.S.C. 154(b) by 398 days.

(21) Appl. No.: 10/472,006

(22) PCT Filed: Mar. 15, 2002

(86) PCT No.: PCT/AU02/00286

§ 371 (c)(1),
(2), (4) Date: Sep. 15, 2003

(87) PCT Pub. No.: WO02/075053

PCT Pub. Date: Sep. 26, 2002

(65) Prior Publication Data

US 2004/0081771 A1 Apr. 29, 2004

(30) Foreign Application Priority Data

Mar. 16, 2001 (AU) ..... PR3788
Jul. 30, 2001 (AU) ..... PR6674

(51) Int. Cl.
*A41G 1/00* (2006.01)

(52) U.S. Cl. ..... 428/17

(58) Field of Classification Search ..... 428/17, 428/25; 108/56.1; 472/92
See application file for complete search history.

(56) References Cited

U.S. PATENT DOCUMENTS

| | | | | |
|---|---|---|---|---|
| 3,735,988 | A * | 5/1973 | Palmer et al. | 473/162 |
| 3,837,980 | A | 9/1974 | Nishimura et al. | 428/17 |
| 3,940,522 | A | 2/1976 | Wessells | 428/17 |
| 4,138,514 | A * | 2/1979 | Terpay | 428/17 |
| 4,336,286 | A | 6/1982 | Tomarin | 428/17 |
| 4,396,653 | A * | 8/1983 | Tomarin | 428/17 |
| 5,120,158 | A * | 6/1992 | Husu | 405/43 |
| 5,205,791 | A * | 4/1993 | Pledger | 472/126 |
| 5,309,846 | A * | 5/1994 | Peterson | 108/53.3 |
| 5,601,886 | A * | 2/1997 | Ishikawa et al. | 428/17 |
| 6,216,389 | B1 | 4/2001 | Motz et al. | 47/58.1 R |
| 6,472,041 | B1 | 10/2002 | Burke | 428/86 |
| 6,527,889 | B1 | 3/2003 | Paschal et al. | 156/72 |
| 2004/0058096 | A1 * | 3/2004 | Prevost | 428/17 |
| 2005/0008793 | A1 * | 1/2005 | Prevost | 428/17 |

FOREIGN PATENT DOCUMENTS

| | | |
|---|---|---|
| AU | A-54901/90 | 5/1989 |
| AU | A-21155/92 | 8/1992 |
| DE | 43 04711 A1 | 9/1993 |
| EP | 0 174 755 | 10/1989 |

(Continued)

*Primary Examiner*—Jennifer McNeil
*Assistant Examiner*—Gordon R. Baldwin
(74) *Attorney, Agent, or Firm*—Gordon & Jacobson, PC

(57) ABSTRACT

A pre-formed synthetic turf module (10) includes a base tray (12), a flexible backing sheet (36) tufted with synthetic ribbons simulating grass blades, and a granular media infill material (40) in the voids between the ribbons, the tufted backing sheet and infill material being supported on the base tray so that a plurality of the modules may be installed side-by-side to form a media-filled synthetic turf surface. Each module may also include a peripheral wall (14) which is removed during the installation. A method of installing a synthetic turf surface, and the installation of heating elements (50) in the surface, are also disclosed.

18 Claims, 8 Drawing Sheets

FOREIGN PATENT DOCUMENTS

| | | | |
|---|---|---|---|
| EP | 1178155 | | 2/2002 |
| FR | 2 616 674 | | 6/1987 |
| FR | 2618345 | | 7/1987 |
| FR | 2 633 844 | | 7/1988 |
| GB | 2 087 959 | A | 4/1981 |
| GB | 2 253 638 | | 9/1992 |
| JP | 07317010 | | 12/1995 |
| JP | 07317011 | | 12/1995 |
| JP | 09100509 | | 4/1997 |
| JP | 09203007 | | 8/1997 |
| JP | 09217311 | | 8/1997 |
| JP | 09273107 | | 10/1997 |
| JP | 09273108 | | 10/1997 |
| JP | 10204815 | | 8/1998 |
| JP | 11093112 | | 4/1999 |
| JP | 11107207 | | 4/1999 |
| WO | WO 92/05317 | | 4/1992 |
| WO | WO 94/18393 | | 8/1994 |
| WO | WO 98/40559 | | 9/1998 |
| WO | WO 01/05257 | | 1/2001 |
| WO | WO 01/48322 | | 7/2001 |
| WO | WO 02/075054 | | 9/2002 |

* cited by examiner

SYNTHETIC SPORTS SURFACE

BACKGROUND OF THE INVENTION

1. Field of the Invention

The invention relates to a synthetic turf surface and a method of installation. In particular, the invention relates to a synthetic sports and recreation surface with improved ease of installation.

2. State of the Art

Synthetic turf is known and widely used for recreational areas and for sporting pursuits such as tennis, lawn bowls, horse racing, hockey and football. Such synthetic turf surfaces are formed as a flexible backing sheet into which is stitched (tufted) parallel rows of synthetic ribbons which extend upwards of the backing sheet to simulate blades of grass. The ribbon length and thickness, the gauge between the rows, and the tufting rate between adjacent tufts in each row, will depend on the intended use of the surface. A backing layer, such as latex, may be applied to the back of the backing sheet.

A particulate material, such as one or more layers of sand or crumbed rubber, is used as an infill material between the ribbons, to hold the ribbons generally upright and to provide resilience to the sports surface. The infill level typically extends to a short distance below the tips of the ribbons, so that the exposed ribbon tips resemble the appearance and playing characteristics of grass.

The prior art synthetic turf surfaces are manufactured, transported and installed in large rolls, typically sheets about 50 m by 3.7 m, comprising the backing sheet, any backing layer and the tufted ribbons. The particle size, shape and resilience of the infill material is important to the playing characteristics of the resulting surface, and therefore this infill material is typically sourced by tie synthetic turf manufacturer and transported with the rolls.

After preparation of the supporting surface, the synthetic turf rolls are rolled out with the ribbon side up. Joins between adjacent rolls are effected by taping and/or stitching the unrolled sleets together. Once the synthetic turf is positioned and appropriately tensioned, the infill material is distributed over the turf and groomed to the desired level.

This installation method is time-consuming. Where the installation is temporary, eg. for an indoor tennis tournament lasting about a week, installation and removal of the tennis surface may take almost as long as the tournament itself.

SUMMARY OF THE INVENTION

The present invention aims to provide a synthetic surface construction which allows a more convenient installation method.

The present invention provides a pre-formed synthetic turf module including:

a base tray;

a flexible backing sheet tufted with a plurality of synthetic ribbons extending upwards of the backing sheet to represent grass blades; and a granular media infill material on the backing sheet in the voids between the ribbons;

said base tray supporting said tufted backing sheet and media such that said modules are adapted to be installed side-by-side with one or more similar modules so as to form a media-filled synthetic turf surface.

Preferably, a peripheral wall is attached to said base tray for retaining said media on the module during transport and installation of the module. More preferably, the peripheral wall is removable after installation.

Preferably also, the base tray is configured so as to allow drainage to a drainage space between the underside of the tray and a supporting surface.

A further form of the invention provides a pre-formed synthetic turf module including:

a base tray;

a flexible backing sheet tufted with a plurality of synthetic ribbons extending upwards of the backing sheet to represent grass blades; and a media infill material on the backing sheet in the voids between the ribbons, said infill material including a lower fused layer of infill material and an upper layer of granular media infill material;

said base tray supporting said tufted backing sheet and media such that said modules are adapted to be installed side-by-side with one or more similar modules so as to form a media-filled synthetic turf surface.

A further form of the invention provides a method of installing a synthetic turf surface comprising a plurality of modules.

Further preferred embodiments will now be described with reference to the accompanying drawings:

DETAILED DESCRIPTION OF THE PREFERRED EMBODIMENTS

Figure 1:
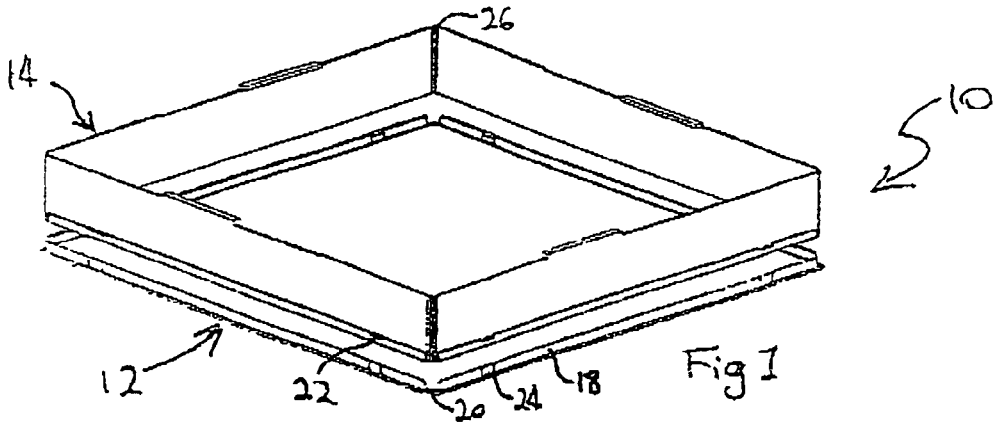
FIG. 1 is an exploded perspective of the base plate and peripheral wall of the base tray.
Figure 2:
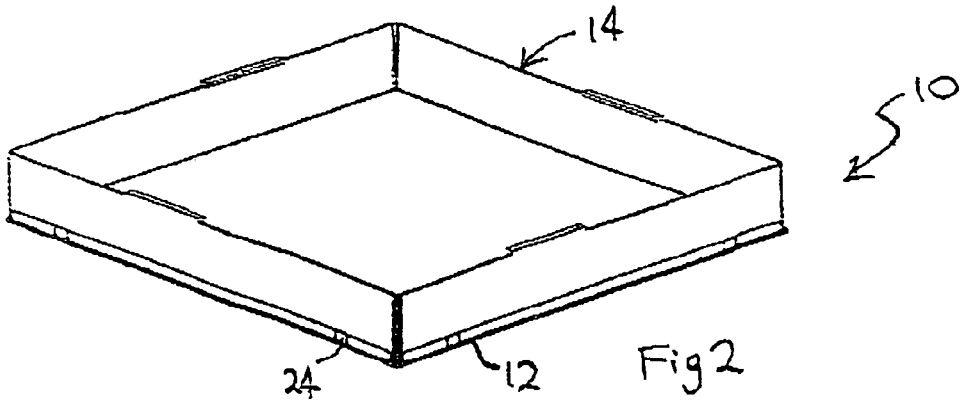
FIG. 2 is a perspective of the base plate and wall of FIG. 1 when assembled.

With reference to FIGS. 1 and 2, the base tray 10 of each module comprises a base plate 12 with a removable peripheral wall 14.

The base plate 12 is sufficiently rigid to support the weight of the completed module during transport and installation, and preferably formed of a non-biodegradable plastics material such as polypropylene or polystyrene. The base plate may have stiffening ribs 16 in its us and/or lower surfaces (see FIG. 5) and one or more drainage formations to facilitate drainage of water from the synthetic turf installation when laid.

The tray is preferably substantially square or rectangular in plan view, but may be any other shape which allows a substantially continuous playing surface to be formed when a plurality of the modules are laid side by side. The tray is preferably of a size which allows the completed module to be lifted and handled by one person, for example about 500 mm by 500 mm. The base plate has a 10-20 mm peripheral flange 18 which allows for removable attachment of the peripheral wall 14, and may have cut-off portions 20 at its corners to assist drainage (see FIG. 3). A small flange 21, about 2-4 mm high, may be provided adjacent the cut-off portion, to retain the free-flowing glue used to adhere the synthetic turf to the tray without significantly affecting drainage.

The peripheral wall 14 is preferably about 50-100 mm high, more preferably about 60-70 mm, and of sufficient rigidity to retain the granular media in the completed module. The wall may suitably be formed of extruded or moulded plastics material such as a polystyrene or polypropylene. The lower portion of the wall has spaced recesses 22 for receiving detents 24 on the flange 18, as will be described in further detail later with reference to FIGS. 4A and 4B.

The peripheral wall is adapted to be collapsible for stacking after removal from the installed module, so that the wall may be returned to the factory for re-use. To this end, the corners 26 of the walls 14 may be hinged, so that the walls maybe collapsed to a relatively flat transport position.

The module may also be provided with a lid (not shown) for transport, which also may be returned to the factory for re-use.

Figure 4A:
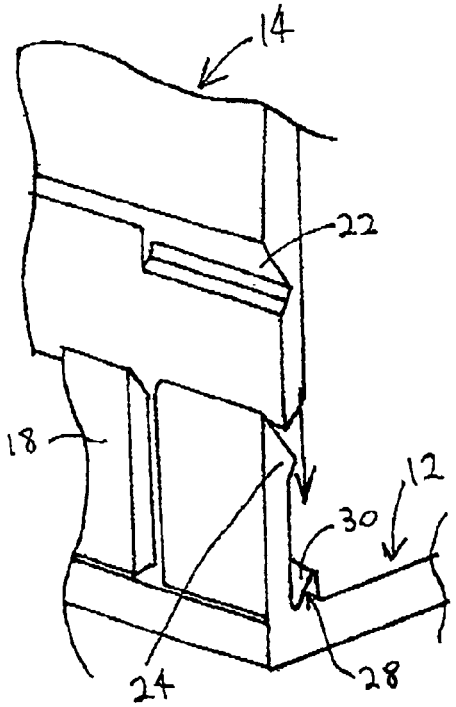
FIGS. 4A and 4B show the catch arrangement attaching the wall to the base plate.
Figure 4B:
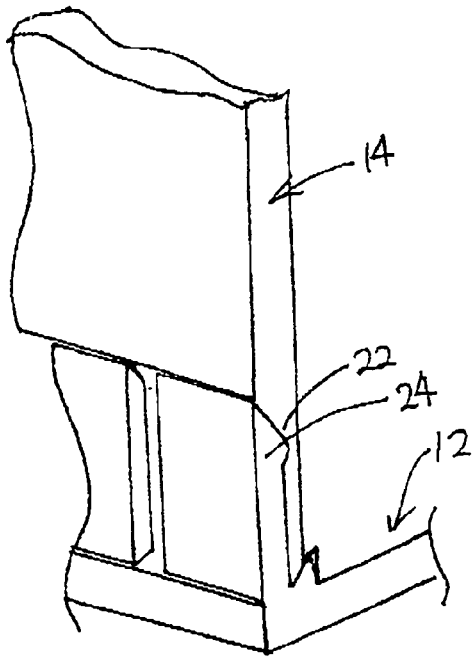

With reference to FIGS. 4A and 4B, the peripheral flange 18 of the base plate 12 has one or more resilient detents 24 which engage with the recesses 22 in the peripheral wall 14 to hold the wall in position. The base plate may also have a second peripheral flange—a small locating flange 28 with a ramped end 30 which as in correct location of the wall, as best shown in FIG. 4B.

The attachment of the wall to the base plate is adapted to release upon application of sufficient upwards force to the wall, so that the walls may be removed from the modules after the installation.

Figure 12A:
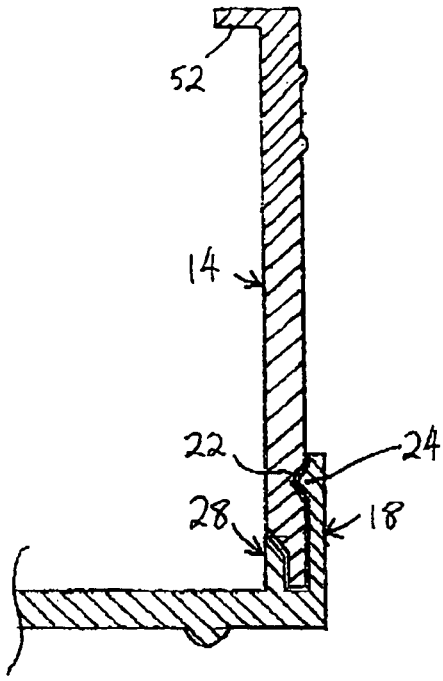
FIGS. 12A and 12B are schematic cross-sectional elevations of an alternative peripheral wall and peripheral flange arrangement taken through the catch and midway along a side of the module, respectively.
Figure 12B:
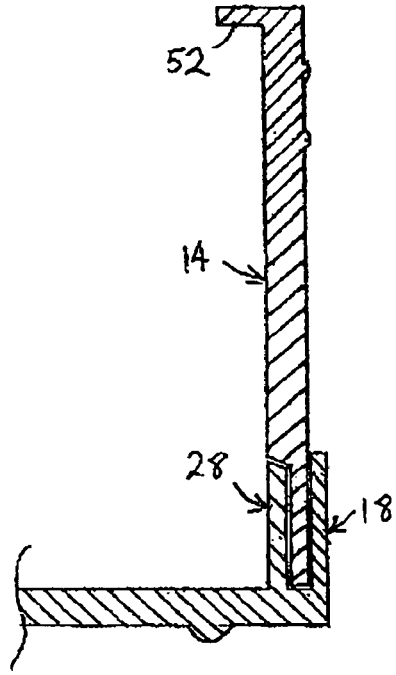

FIGS. 12A and 12B show a cross-section of a modified construction of the peripheral flange and wall arrangement, in which the locating flange 28 is taller then that in FIGS. 4A and 4B. Preferably, the locating flange varies in height from approximately one half the height of the man peripheral flange 18 near the corners of the tray (FIG. 12A) to approximately the full height of flange 18 at the centre of each side (FIG. 12B). The lower portion of the peripheral wall 14 is rebated to match the locating flange 28, so that the bottom edge of the wall is held between the flanges 18 and 28. The outer surface of the wall 14 has e recesses 22 which engage with detents 24 on flange 18 (FIG. 12B).

The top edge of the peripheral wall 14 in FIGS. 12A and 12B has an inwardly turned lip 52, which assists with gripping of the wall by the installer during removal, and also helps retain infill on the module during installation. Optionally, the top of the wall 14 may also have a tab (not shown) protruding above the top of the artificial turf surface when laid, as visible indication of those modules which have not yet had their peripheral walls 14 removed.

Figure 3:
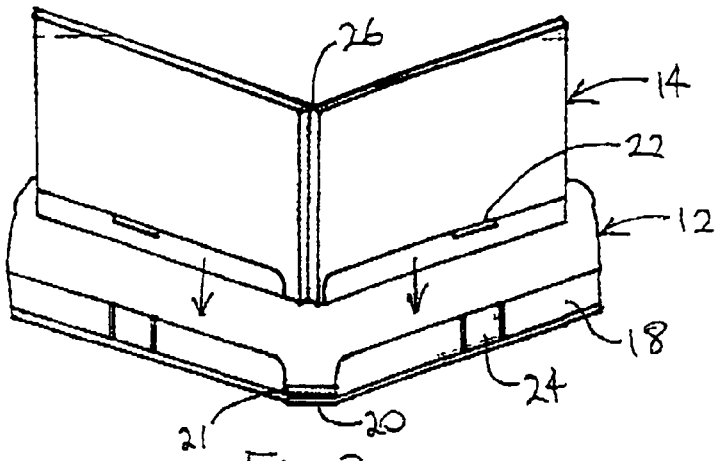
FIG. 3 is a detail of the corner portion of the FIG. 2 assembly.

In the embodiment of FIGS. 12A and 12B, the locating flange 28 continues into the corners of the tray, in place of small flange 21 in FIG. 3, to retain the glue, while peripheral flange 18 is discontinued at the corners to facilitate drainage.

Figure 5:
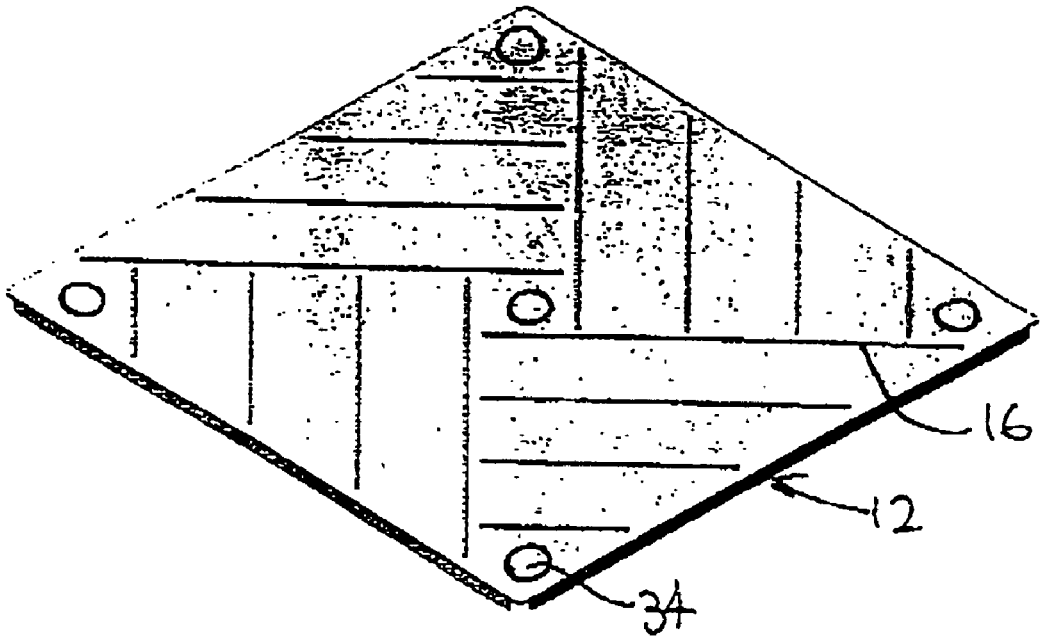
FIG. 5 is a bottom perspective of the tray.

FIG. 5 shows the bottom of the base plate, with a pattern of ribs 16 and glue points 34 formed in the lower surface. The ribs add stiffness to the tray for transport and handling of the module, and also serve to space the lower surface of the tray from the supporting surface to form a drainage gap. Preferably, the rib pattern is adapted to assist lateral drainage along this drainage gap, as is the rid pattern shown in FIG. 5.

Figure 6:
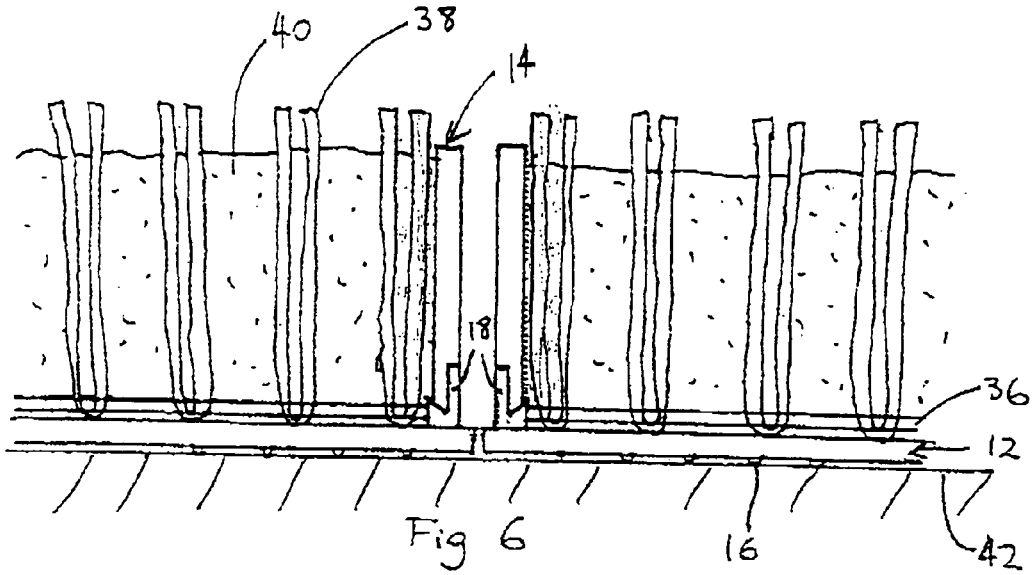
FIG. 6 is a schematic cross-sectional elevation of the adjoining region of two adjacent modules.

FIG. 6 is a cross section elevation of two abutting modules before removal of the peripheral walls. Each module consists of a square base tray of the type described above, with a section of media-filled synthetic turf therein. The synthetic turf square is adhered to the top of the base plate, and sized to fit inside the peripheral wall.

The construction of synthetic turf is well known. Each synthetic turf section comprises a flexible backing sheet 36 formed as one or more layers, into which is tufted parallel rows of synthetic ribbons 38 which simulate grass. The type, thickness, pile length and pattern of the ribbons, the gauge between adjacent rows and the stitch rate within each row can be varied to suit the particular use for the synthetic turf, as is known in the art.

The granular material infill 40 may be of any suitable type, such as sand, ground rubber, plastic beads or combinations thereof, depending on the end use for the synthetic turf surface. The media typically comes up to a level about 5 mm to 10 mm below the tips of the pile, so that the tips are exposed to simulate the look and playing characteristics of grass.

The module construction described above with reference to the Figures is adapted for use with pile lengths up to about 100 mm. Where it is desired to use pile lengths in excess of this, a higher peripheral wall may be desirable.

As shown in FIG. 6, the peripheral walls 14 retain the infill 40 during transport and initial installation of the modules. After positioning and fixing of the modules to the supporting surface 42, the peripheral walls are removed and the surface groomed to level the infill to result in the arrangement shown in FIG. 7. If desired, some additional infill may be added during this grooming process, but this will usually be relatively minor compared to filling and grooming of conventional synthetic turf.

Figure 7:
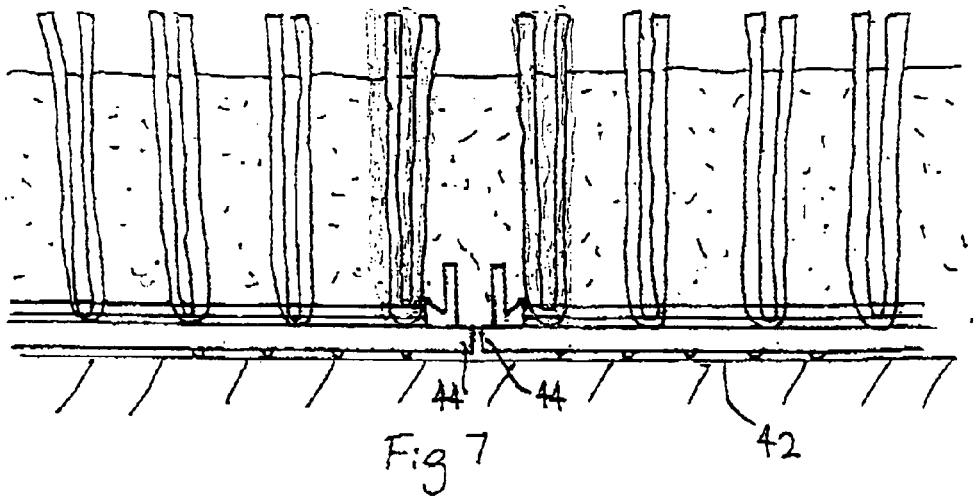
FIG. 7 shows the arrangement of FIG. 6 after removal of the wall and grooming of the surface.

It will be apparent from FIGS. 6 and 7 that the thickness of the peripheral walls and the edge lips 44 of the base plates be kept as small as practical, while still providing adequate strength and drainage. Preferably, the total distance between the inside surfaces of the peripheral walls of abutting modules is less than about 15-20 mm, more preferably a 12 mm or less. In this way, the spacing between the edge rows of ribbons in abutting modules will not be noticeably larger than the gauge of the pile, so the joins will not be visible in the playing surface.

The illustrated embodiment thus allows rapid and convenient installation of a synthetic turf surface, even in weather conditions which might impede laying and filling of a conventional surface. Also, the modules may be repositioned after installation, so that worn sections from high wear areas can be replaced, or swapped with less worn ones.

Figure 8:
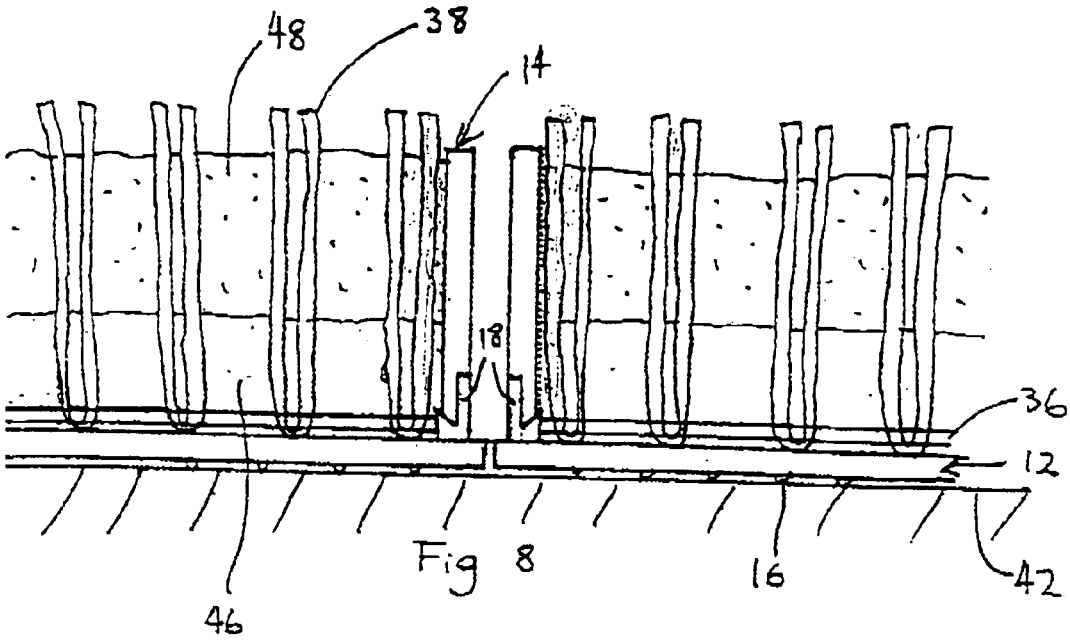
FIG. 8 illustrates an alternative infill arrangement.

By providing an arrangement in which the synthetic turf is adhered to the base tray of the module and the infill material added in the factory, the invention also allows the use of the novel and inventive infill arrangement shown in FIG. 8. In that arrangement, which is particularly advantageous for long pile synthetic turfs over about 25 mm, a base layer 46 of the infill is formed by adding an infill layer of foamed plastics beads and heating the turf and infill in the module so that the beads fuse together. One or more additional infill layers 48 may then be applied.

Desirably, this method may be carried out by applying an infill of 2-3 mm beads of foamed polystyrene or other suitable plastics material, and applying steam or other heat source to expand the beads to form a lightly fused layer. Care must be taken not to subject the base tray and synthetic turf to excessive temperatures during this operation. The fused base layer may then be covered by sand, rubber or other known infill materials.

Figure 9:
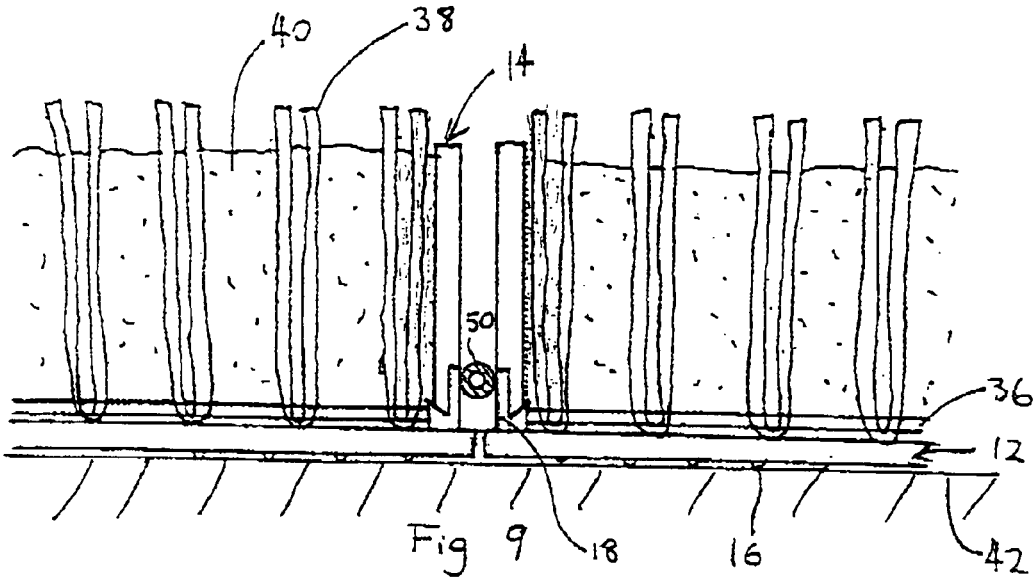
FIGS. 9 and 10 are schematic cross-sectional elevations showing inclusion of tubes for heating the sports surface.
Figure 10:
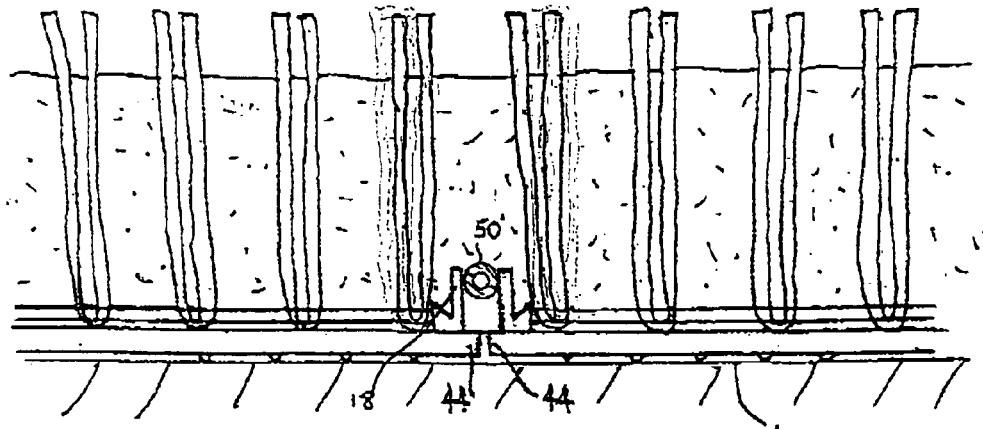

FIGS. 9 and 10 show the abutment of two adjacent modules, including heating fluid tubes 50 laid in the spaces between the peripheral walls 14 and/or peripheral flanges 18 of the modules prior to removal of the walls 14 (FIG. 9). These heating fluid tubes 50 become covered with the granular material 40 when the peripheral walls 14 are removed (FIG. 10).

The heating tubes 50 are preferably flexible, and of sufficiently small diameter (e.g 8-10 mm) to fit between the adjacent modules and lay deep enough within the infill material 40 to avoid damage during use of the surface.

Figure 11:
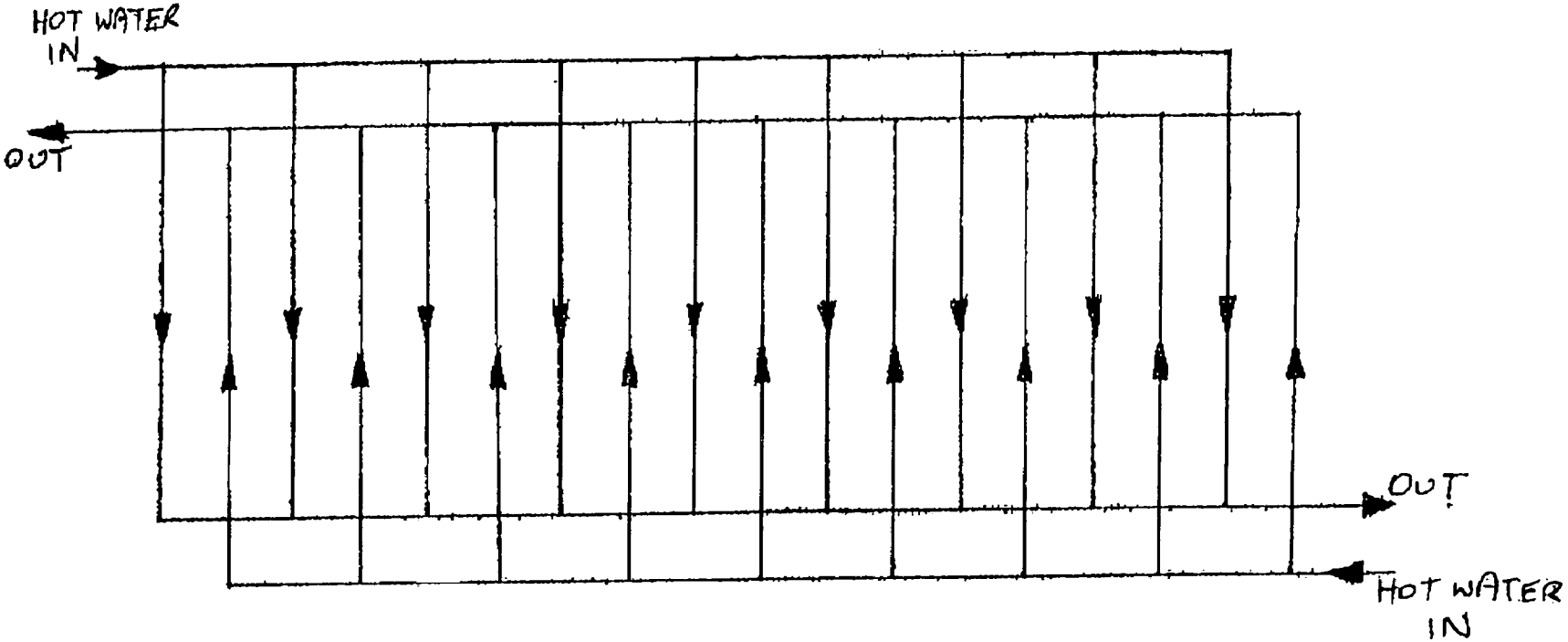
FIG. 11 is a schematic plan showing the arrangement of the heating tubes.

With reference to FIG. 11, the tubes 50 are connected to sources of hot water or other fluid, to heat the sports surface sufficiently to keep it substantially clear of snow and ice.

Preferably, the tubes are laid parallel, along opposed edges of each module, with the hot fluid direction alternating between rows, transversely across the field as shown schematically in FIG. 11. However, where the synthetic sports surface is laid in an area of extreme cold or heavy snowfall, it will be possible to lay the heating tubes 50 in both the transverse and longitudinal directions, with the tubes 50 being protected by the particulate material 40 even in the regions of overlap.

In an unillustrated embodiment, the heating tubes may be replaced by low voltage heating elements for heating the sports surface.

While the invention has been described above with reference to synthetic turfs which simulate the appearance of grass, it should be appreciated that the invention also may be used for synthetic 'turf' of the type which simulates a clay surface, in which the infill level extends above the tips of the pile.

While particular embodiments of this invention have been described, it will be evident to those skilled in the art that the present invention maybe embodied in other specific forms without departing from the essential characteristics thereof. The present embodiments and examples are therefore to be considered in all respects as illustrative and not restrictive, and all modifications which would be obvious to those skilled in the art are therefore intended to be embraced therein. It will further be understood that any reference herein to known prior art does not, unless the contrary indication appears, constitute an admission that such prior art is commonly known by those skilled in the art to which the invention relates.

The invention claimed is:

1. A pre-formed synthetic turf module including:

a base tray including a peripheral wall that defines enclosed space accessible from above said base tray, said enclosed space for retaining a flexible backing sheet and granular infill material therein;

an outwardly protruding lip extending away from a lower portion of said peripheral wall;

said flexible backing sheet tufted with a plurality of synthetic ribbons extending upwards of the backing sheet to represent grass blades; and said granular media infill material disposed on the backing sheet in the voids between the ribbons;

said base tray supporting said tufted backing sheet and said granular infill material such that said module is adapted to be installed side-by-side with one or more similar modules so as to form a media-filled synthetic turf surface, said lip defining a space thereabove for retaining granular media infill material between the peripheral walls of two adjacent modules when said two adjacent modules are installed side-by-side.

2. A pre-formed synthetic turf module according to claim 1 wherein said peripheral wall is attached to said base tray for retaining said media on the module.

3. A pre-formed synthetic turf module according to claim 2 wherein said peripheral wall is removable from said base tray after installation of the module.

4. A pre-formed synthetic turf module according to claim 3 wherein said peripheral wall is collapsible after removal from said base tray.

5. A pre-formed synthetic turf module according to claim 4 wherein said peripheral wall includes one or more hinge portions configured to allow collapsing of said peripheral wall.

6. A pre-formed synthetic turf module according to claim 3 wherein the base tray includes a peripheral flange which retains said peripheral wall.

7. A pre-formed synthetic turf module according to claim 6 wherein the peripheral flange and peripheral wall have cooperating engagement means for retaining the peripheral wall.

8. A pre-formed synthetic turf module according to claim 7 wherein said engagement means includes a detent in said peripheral flange which engages with a recess in said peripheral wall.

9. A pre-formed synthetic turf module according to claim 6 wherein said peripheral flange is discontinuous at one or more corners of said base tray.

10. A pre-formed synthetic turf module according to claim 9 wherein said backing sheet is glued to said base tray using a glue, and said base tray includes a further peripheral flange which is continuous, said continuous peripheral flange being adapted to prevent said glue from escaping through said discontinuous flange on said base tray.

11. A pre-formed synthetic turf module according to claim 1 wherein said base tray includes one or more projections on an underside thereof, so as to form a drainage space between said base tray and a supporting surface.

12. A pre-formed synthetic turf module according to claim 1 wherein said space is adapted to accommodate at least one heating element between said adjacent modules.

13. A pre-formed synthetic turf module according to claim 12 wherein said heating element is selected from the group including an electric heating element and a heating fluid tube.

14. A pre-formed synthetic turf module including:

a base tray including a peripheral wall that defines enclosed space accessible from above said base tray, said enclosed space for retaining a flexible backing sheet and media infill material therein;

an outwardly protruding lip extending away from a lower portion of said peripheral wall;

said flexible backing sheet tufted with a plurality of synthetic ribbons extending upwards of the backing sheet to represent grass blades; and said media infill material disposed on the backing sheet in the voids between the ribbons, said media infill material including a lower fused layer of infill material and an upper layer of granular infill material;

said base tray supporting said tufted backing sheet and media infill material such that said module is adapted to be installed side-by-side with one or more similar modules so as to form a media-filled synthetic turf surface, said lip defining a space thereabove for retaining media infill material between the peripheral walls of two adjacent modules when said two adjacent modules are installed side-by-side.

15. A pre-formed synthetic turf module according to claim 14 wherein said fused layer is formed from fused beads of foamed plastics material.

16. A pre-formed synthetic turf module according to claim 15 wherein said beads are fused by steam applied to said module before application of said upper layer.

17. A pre-formed synthetic turf module according to claim 14 wherein said space is adapted to accommodate at least one heating element between said adjacent modules.

18. A pre-formed synthetic turf module according to claim 17 wherein said heating element is selected from the group including an electric heating element and a heating fluid tube.

* * * * *